United States Patent [19]

Groves

[11] Patent Number: 4,765,519

[45] Date of Patent: Aug. 23, 1988

[54] ATHLETIC GLOVE POCKET FORMER AND METHOD FOR USING THE SAME

[76] Inventor: Keith N. Groves, 3200 McLeod Dr., Apt. 210, Las Vegas, Nev. 89121

[21] Appl. No.: 15,012

[22] Filed: Feb. 17, 1987

[51] Int. Cl.[4] ..... A41D 1/00

[52] U.S. Cl. ..... 223/78; 2/19; 206/278

[58] Field of Search ..... 223/78, 84, 66; 2/19; 206/278, 315.9

[56] References Cited

U.S. PATENT DOCUMENTS 4,061,170 12/1977 Marks ..... 206/278 X 4,418,849 12/1983 Santa ..... 2/19 X

*Primary Examiner*—Werner H. Schroeder

*Assistant Examiner*—Judith L. Olds

[57] ABSTRACT

An athletic glove pocket retaining and former device comprising a ball like object having at least one bendable strap having means, such as velcro, attached to the approximate middle of said strap joined to said ball like object, and having joining means, such as velcro, attached to the terminal ends of said strap so as to permit the strap ends to be tightly joined together when the ball like object is placed in the pocket of the glove.

11 Claims, 1 Drawing Sheet

ATHLETIC GLOVE POCKET FORMER AND METHOD FOR USING THE SAME

BACKGROUND OF THE INVENTION

1. Field of the Invention

This invention relates to a new and valuable piece of sports equipment. More particularly, the invention relates to a new type of glove pocket former to be used in keeping baseball and softball receiver gloves in proper condition and a method for its use.

Specifically, the invention provides a new type of product which can be inserted into the already formed outward pocket of a baseball or softball receiver's glove or mitt to maintain during storage the pocket in the proper depth and form, which glove pocket former comprises a ball like object having at least one bendable strap having joining means in the approximate center of the strap to be attached to the said ball like object, such as by Velcro joining means, and having locking or joining means, such as Velcro material, attached to the terminal ends of said strap so as to permit the strap ends to be tightly joined together whenthe ball like object is placed in the pocket of a glove.

The invention further provides a method for using the said glove pocket formers which comprises placing the ball like object into the pocket of the glove which is to be stored with the terminal ends of the strap on the outward side of the ball like object, pulling and bending the ends of the strap around the opposite side of the glove and locking or joining them tightly together at the back of the glove and thereby retaining the ball within the pocket of the glove.

Gloves used in baseball and softball to catch and retrieve balls, such as the catcher's glove, pitcher's glove and outfielder's gloves all possess a pocket in the outward center of the front of the glover where the ball is caught and retained. For proper use of the glove it is important that the pocket be retained in the proper form so that the ball can be easily caught and held at the proper time. New gloves generally do not have a proper pocket formed for the type of ball to be played, and it is necessary for the player to form the desired pocket by repeatedly tossing the ball into his own glove and forming the correct pocket. However, after the glove is used and then placed in storage, the pocket is again lost and it is necessary for the player, on taking up the glove again, to repeat the steps of tossing the ball into the glove to form the needed pocket again. This takes some time and when hastely done the pocket may not be in the desired shape. It would be very helpful, therefore, if some means could be found to retain the pocket during storage so as to avoid the constant need for remaking the pocket before each use.

2. Prior Art

While the problem has been with the sporting industry for some time, there have been no successful attempts to solve the problem. At most some of the players tie strings about the glove to keep the pocket partly in shape, but this is every inefficient as the string is generally lost or takes time to tie the string tightly enough around the glove to hold it in place, and no former has been retained in the pocket.

It is an object of the invention, therefor, to provide a new type of product to be used in retaining the pocket in gloves during storage. It is a further object to provide a glove pocket retaining device that can be easily stored and quickly applied to the glove. It is a further object to provide a glove pocket retaining device that keeps the pocket in the same condition no matter the length of storage. It is a further object to provide a glove pocket retaining device that can be varied to fit the type of ball being used and to retain the pocket in the exact form needed. It is a further object to provide a new glove pocket forming device that is simple and economically prepared. These and other object of the invention will be apparent from the following detailed description thereof.

SUMMARY OF THE INVENTION

It has now been discovered that these and other objects can be accomplished by the new products of the present invention which presents for the first time an economical and efficient method for retaining the pocket in athletic goves as used in baseball and softball.

The new glove pocket retaining device of the present invention comprises a ball like object having at least one bendable strap having joining means in the approximate center of the strap to be attached to the said ball, such as by Velcro means, and having locking or joining means, such as Velcro, attached to the terminal ends of said strap so as to permit the strap ends to be tightly joined together when the ball is placed in the pocket of the glove.

The new glove pocket retaining device of the present is utilized in a very quick efficient manner by merely placing the said device in the already pocket formed in the glove and then pulling the straps tightly around the outside of the glove and joining them together so as to hold the device securely in the pocket of the glove.

It has been surprisingly found that when the above-described glove pocket retaining device is place in the center of the pocket of an athlete's glove and the straps then pulled around the side of the glove and locked together at the back of said glove, the device remains tightly within the pocket and maintains the shape of the pocket as long as the device remains in place. The device is extremely easily to fasten in the glove as it readily slides into the pocket and the straps are easily locked together, particularly when the Velcro material is placed at the end of the straps.

Further advantage is also found in the fact that the glove pocket retaining device can be prepared from the regulation baseball or softballs themselves, as the strap can be joined to such balls in the middle of the strap by means, such as Velcro material, and such balls placed in the pocket so as to form the pocket needed for that type of ball. Furthermore, the pocket can be increased or decreased by using smaller or larger balls or by using a series of small or large balls joined together as by the use of Velcro or other joining means.

In any of the above-noted situations, the glove pocket former and retaining device can be easily stored with the baseball or softball equipment when not in use and can be made easily available after the game to give the pocket protection needed during the subsequent storage period.

DESCRIPTION OF THE DRAWING

The various objects and features of the present invention will be more fully understood by reference to the accompanying drawing.

DESCRIPTION OF THE PRODUCT OF THE INVENTION

Figure 2:
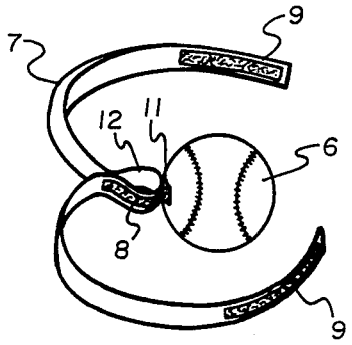
FIG. 2 is a top view of the glove pocket former and retainer showing the ball and straps.

With reference to FIG. 2 of the drawing which is a top view of the glove pocket former and retainer, the ball like object 6 is attached to a strap 7 at point 11. A loop 12 has been formed in the approximate middle of the strap 7 and has Velcro material 8 attached to the outside of the loop and permits joining at 11. The terminal ends of the strap 7 possess joining means 9, which is exemplified in the drawing as a strip of Velcro.

Figure 1:
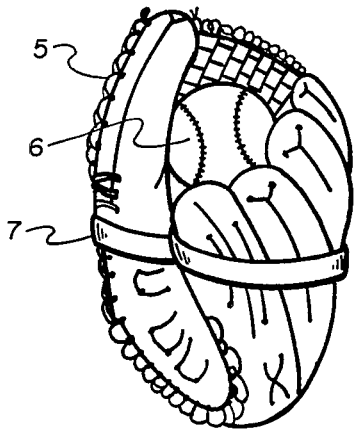
FIG. 1 is a perspective view of a glove in which the glove pocket former and retainer is in place and the straps pull around the glove.

FIG. 1 of the drawing illustrates how the new glove pocket former is utilized in the glove. The ball of the pocket former 6 is placed in the center of glove 5 and the ends of strap 7 then pulled around and joined in the back of the glove.

Figure 3:
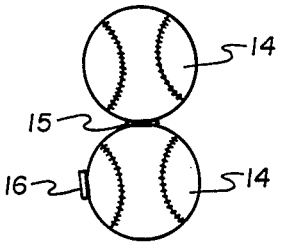
FIG. 3 is an illustration of a series of ball that can be used in preparing the pocket former and retainer.

FIG. 3 is an illustration of a set of balls that can be used in place of the single ball in the glove pocket former of the present invention. The two balls 14 are joined together at 15 by joining means, such as the illustrated Velcro strip, and one of the balls then joined at the side 16 to the strip 7 which is then pulled around the glove as shown in FIG. 1 described above.

When the player desires to utilize his glove, he can then pull the ends of strip 7 apart at the back of the glove and the pocket retainer and former is then removed and kept ready for subsequent storage.

The ball like object to be used in preparing the glove pocket former and retainer can be any type of object which on being pressed into the pocket will help form and retain the pocket in the desired shape. The object can be a softball, hard ball, tennis ball or any other type of ball which will accomplish the above-noted purpose. The ball may be a real softball or baseball or a plastic, wood, metal or other type of ball. In general, the ball is preferably the type of ball which is to be used in the game to be played so that the said ball can be easily detached from the strap and utilized directly in the game.

As shown in FIG. 3, the ball like object may be a series of one or more balls joined together and one of the balls then joined to the straps as noted above. Such series of balls may be similar to each other or different and may be made of the various materials as described above.

The strap to be attached to the ball like object in forming the new glove pocket former may be of any type and length as long as it accomplishes the purpose of being attached to the ball and being capable of being pulled around the glove and joined together to hold the device tightly in the pocket. The strap is generally rather narrow strip of bendable material, such as leather, webbing, canvas, plastic, etc. The width and length may vary but the preferred strap is generally a nylon strip varying from about 24 inches to 28 inches with a width varying from about $\frac{1}{3}$ inch to about 1 inch. The strap is preferably from $\frac{1}{8}$ to $\frac{1}{4}$ inches in thickness.

The strap may be a single strap or two straps joined together at the ball like object. In addition there may be a series of straps, all of which are joined to the ball like object at the approximate middle of each strap.

Particularly superior results are obtained when the strap is looped at the center as shown in FIG. 2 with the loop being joined to the ball like object, such as by Velcro material. The loop imparts the unexpected advantage of giving a tight fit in the glove despite the size of the glove, pocket and ball. When the ball like object is small or the pocket deep, the loop exspands out and hold the ball tightly in the pocket, and when the ball is larger it fits snugly in the pocket and still holds the former tightly in the said pocket.

It is apparent that the strap can be carried separately to the event and applied directly to any of the balls used in the ball game.

The strap or straps can be attached to the ball like object in any suitable manner. They can be attached to the ball, such as by the use of material, such as Velcro, or they may be glued to the ball as by means as synthetic glues, screws, bolts, welding and the like as when the ball is wooden or metal. Preferably, the strap or straps are attached by Velcro material which may be used in strips, such as 1 to 4 inches, and may be the same width, small or larger than the straps themselves. Preferred Velcro material varies from about $\frac{1}{16}$ to $\frac{1}{4}$ inches in thickness. As noted above, the preferred strap is made by a loop in the middle of the strap and a strip of Velcro material attached to the outside of the loop end that is then attached to the ball like object.

The terminal ends of the straps sections possess some means to effect a joining of the ends together to cause the device to be firmly held in the pocket of the glove. The joining means, may be a conventional buckel or slip joint, or in the case shown in the drawing the joining means may be strips of Velcro material attached to both terminal ends so that they may be quickly and easily joined together as well as loosened when one needs to remove the device.

SPECIFIC EMBODIMENT OF THE INVENTION

A specific embodiment of the new product and use of the present invention is illustrated below.

A glove pocket former and retainer was prepared by selecting a standard baseball and attaching thereto a strip of nylon comprising a $\frac{3}{4}$ inch$\times$26 inch nylon strap prepared from about $\frac{1}{8}$ inch material. A 3 inch loop was formed in the center of the strap and a 3 inch strip of Velcro material place at the end of the loop and the loop attached to the side of the baseball. On each of the terminal end of the strap were placed 3 inch Velcro strips (about the same width as the strap) so that when the ball was placed in the glove the straps could be quickly pulled around the glove and joined together.

The glove pocket former and retainer prepared as above was then placed in a pitcher's glove with the ball of the device firmly fitted into the pocket of the glove. The two nylon straps were then pulled around the outside of the glove and joined together with the Velcro strips so as to hold the ball firmly in the pocket. The glove with the new glove pocket former and retainer was then placed in the storage bag of the team and kept there for a period of two weeks. At the end of that time, the equipment was used again and the pitcher took out his glove, quickly pulled the straps apart and began to use his glove. The device had retain a perfect pocket in the glove and there was no need to again develop such a pocket before the game. In addition, the device was quickly removed and caused no additional effort on the part of the pitcher.

I claim as my invention:

1. An athletic glove former and retainer comprising a ball like object and a strap consisting of a narrow strip of bendable material with joining means attached to the surface of said strap near the center thereof and joining means attached to the surface of said strap at the two terminal free ends of said strap, the said strap being joined to the surface of the ball like object by the joining means near the center of said strap, with the two terminal free ends of the strap being free to permit them to be tightly pulled around the outside of a glove and tightly joined together by joining means at the two ends of said strap when the ball like object is placed in the pocket of a glove.

2. A glove pocket former as defined in claim 1 wherein the joining means at the center and at the ends of the strap comprise hook and pile type fasteners.

3. A glove pocket former device as in claim 1 wherein the ball like object is a plastic ball the size of a baseball and has the strap ends attached to the outward side of the ball by means of hook and pile type fasteners.

4. A glove pocket former device as in claim 1 wherein the ball like object is a softball and has the ends of the strap cover with a hook and pile type fastener as the joining means.

5. A glove pocket former as defined in claim 1 wherein the ball like object is a series of balls joined together by hook and pile type fasteners, and one of the balls is joined at the front to the said strap.

6. A process for retaining a pocket in an athletic glove which comprises placing in the pocket of the glove a retainer comprising a ball like object and a strap consisting of a narrow strip of bendable material with joining means attached to the surface of said strap near the center thereof and joining means attached to the surface of said strap at the two terminal free ends of said strap, the said strap being joined to the surface of the ball like object by the joining means near the center of said strap, with two terminal free ends of the strap being free to permit them to be tightly pulled around the outside of the glove, pulling the two free ends of the said strap around the outside of said athletic glove and joining the two ends together by the joining means at the ends of said strap.

7. A process as in claim 6 wherein the joining means at the terminal ends comprise hook and pile type fasteners.

8. A process as in claim 6 wherein the strap is a nylon strap of between 18 to 30 inches in length and about ½ to ¾ inches in width.

9. A process as in claim 6 wherein the ball like object is a plastic baseball.

10. A process asin claim 6 wherein the ball like object is a series of balls joined together with one ball being joined to the strap.

11. A bendable strap for use in holding a ball like object in the pocket of an athletic glove consisting of a narrow strip of bendable material with joining means attached to the surface of said strap near the center thereof to permit it to be attached to the surface of a ball like object, and joining means attached to the surface of said strap at the two terminal ends thereof so that the two terminal ends are free to be pulled around the outside of a glove and tightly joined together by the joining means at the ends of said strap.

* * * * *